US011578877B2

(12) United States Patent
Cho et al.

(10) Patent No.: US 11,578,877 B2
(45) Date of Patent: Feb. 14, 2023

(54) AIR CONDITIONER HAVING FAN MODULE WITH INSTALLATION SPACE AND STABILIZER MODIFIER SPACED APART FROM THE FAN MODULE

(71) Applicant: SAMSUNG ELECTRONICS CO., LTD., Suwon-si (KR)

(72) Inventors: Huisang Cho, Suwon-si (KR); Yongho Seo, Suwon-si (KR); Byungghun Kim, Suwon-si (KR); Sewoong Youn, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 43 days.

(21) Appl. No.: 17/096,378

(22) Filed: Nov. 12, 2020

(65) Prior Publication Data

US 2021/0156571 A1 May 27, 2021

(30) Foreign Application Priority Data

Nov. 22, 2019 (KR) ..... 10-2019-0151006

(51) Int. Cl.
*F24F 1/0033* (2019.01)
*F24F 13/20* (2006.01)
(Continued)

(52) U.S. Cl.
CPC ..... *F24F 1/0033* (2013.01); *F24F 1/0025* (2013.01); *F24F 13/20* (2013.01);
(Continued)

(58) Field of Classification Search
CPC .... F24F 1/0025; F24F 113/20; F24F 113/222; F24F 2013/205; F24F 1/0033; F24D 17/04
See application file for complete search history.

(56) References Cited

U.S. PATENT DOCUMENTS

2014/0102676 A1* 4/2014 Tadokoro ..... F24F 1/0025 454/251
2018/0112888 A1* 4/2018 Na ..... F04D 29/666

FOREIGN PATENT DOCUMENTS

CN 103968517 A * 8/2014 ..... F04D 17/04
CN 105387592 A * 3/2016 ..... F24F 1/0025
(Continued)

OTHER PUBLICATIONS

International Search Report dated Feb. 24, 2021, in corresponding International Patent Application No. PCT/KR2020/015067.
(Continued)

*Primary Examiner* — Edelmira Bosques
*Assistant Examiner* — Michael James Giordano
(74) *Attorney, Agent, or Firm* — Staas & Halsey LLP

(57) ABSTRACT

Provided is an air conditioner. The air conditioner comprising a housing having an inlet and an outlet, a fan in the housing to suck in air through the inlet and discharge air through the outlet, and including a plurality of fan blades with an installation space between two fan blades of the plurality of fan blades, a fan driver coupled to an end of the fan by a fastener, to drive the fan, wherein the installation space is positioned to allow the fastener to pass through the installation space to couple the fan driver to the fan, and a stabilizer including a body having at least a portion extending along the fan at a first distance from the fan, and so as to not be over the installation space as the fan rotates, and a modifier extending along the fan at a second distance, which is greater than the first distance, from the fan, and so as to be over the installation space for at least part of a full rotation of the fan as the fan rotates.

16 Claims, 7 Drawing Sheets

(51) Int. Cl.
*F24F 1/0025* (2019.01)
*F24F 13/24* (2006.01)
*F24F 13/22* (2006.01)

(52) U.S. Cl.
CPC ..... *F24F 13/222* (2013.01); *F24F 13/24* (2013.01); *F24F 2013/205* (2013.01)

(56) References Cited

FOREIGN PATENT DOCUMENTS

| | | | | | |
|---|---|---|---|---|---|
| CN | 108799201 | A | * | 11/2018 | ..... F04D 29/403 |
| EP | 1 318 356 | A1 | | 6/2003 | |
| EP | 2 657 530 | A1 | | 10/2013 | |
| EP | 2 902 632 | A1 | | 8/2015 | |
| EP | 2 957 773 | A1 | | 12/2015 | |
| JP | 64-63697 | A | | 3/1989 | |
| JP | 7-52016 | B2 | | 6/1995 | |
| JP | 2005-37001 | A | | 2/2005 | |
| JP | 4187032 | B2 | | 11/2008 | |
| JP | 2013079617 | A | * | 5/2013 | ..... F04D 17/04 |
| JP | 2015-121204 | A | | 7/2015 | |
| JP | 2019-124164 | A | | 7/2019 | |
| KR | 1999-009785 | A | | 2/1999 | |
| KR | 10-1392088 | B1 | | 5/2014 | |

OTHER PUBLICATIONS

Extended European Search Report dated Mar. 22, 2021, in corresponding European Patent Application No. 20208768.0.
Office Action dated Oct. 24, 2022, issued in European Application No. 20 208 768.0.

* cited by examiner

AIR CONDITIONER HAVING FAN MODULE WITH INSTALLATION SPACE AND STABILIZER MODIFIER SPACED APART FROM THE FAN MODULE

CROSS-REFERENCE TO RELATED APPLICATION

This application is based on and claims priority under 35 U.S.C. § 119 to Korean Patent Application No. 10-2019-0151006 filed on Nov. 22, 2019, the disclosure of which is incorporated herein by reference in its entirety.

BACKGROUND

1. Field

The disclosure relates to an air conditioner, and more particularly, to an air conditioner having a stabilizer.

2. Discussion of Related Art

In general, an air conditioner is a device for controlling temperature, humidity, airflows, airflow distribution, etc., to be right for human activities and simultaneously, eliminating dust or something in the air by using refrigeration cycles. The refrigeration cycle involves a compressor, a condenser, an evaporator, an expansion valve, and a fan as the primary elements.

The air conditioners may be classified into split air conditioners with indoor and outdoor units separately installed, and packaged air conditioners with indoor and outdoor units installed together in a single cabinet. The indoor unit of the split air conditioner includes a heat exchanger for exchanging heat of the air sucked into the panel, and a fan for sucking the room air into the panel and blowing out the air back into the room.

The air conditioner may include a stabilizer for determining a blowing direction of the fan. The stabilizer may be formed to surround a portion of the fan with a certain distance to the fan to separate an air sucking path from an air discharging path of the fan, and to determine a position and intensity of a vortex of air being discharged.

SUMMARY

The disclosure provides an air conditioner capable of reducing noise.

The disclosure also provides an air conditioner capable of reducing noise while preventing a loss of air volume.

According to an aspect of the disclosure, an air conditioner includes a housing having an inlet and an outlet, a fan in the housing to suck in air through the inlet and discharge air through the outlet, and including a plurality of fan blades with an installation space between two fan blades of the plurality of fan blades, a fan driver coupled to an end of the fan by a fastener, to drive the fan, wherein the installation space is positioned to allow the fastener to pass through the installation space to couple the fan driver to the fan, and a stabilizer including a body having at least a portion extending along the fan at a first distance from the fan, and so as to not be over the installation space as the fan rotates, and a modifier extending along the fan at a second distance, which is greater than the first distance, from the fan, and so as to be over the installation space for at least part of a full rotation of the fan as the fan rotates.

A first gap may be between the two fan blades of the plurality of fan blades, to thereby from the installation space, and a second gap, smaller than the first gap, is between each two adjacent fan blades the plurality of fan blades, other than the two fan blades.

The modifier may extend from the body.

The installation space may allow at least a portion of a coupling tool for coupling the fan driver to the fan by the fastener to pass therethrough.

The first distance and the second distance may satisfy the following relationship:

$$1.1 \leq \text{the second distance}/\text{the first distance} \leq 1.5$$

The fan may include a first fan module that includes the plurality of fan blades, and is arranged along a rotation axis of the fan at the end of the fan to which the fan driver is coupled, and a second fan module including a plurality of fan blades, arranged adjacent to the first fan module along the rotation axis of the fan, the modifier may extend along the first fan module at the second distance from the first fan module, and the body may extend along the second fan module at the first distance from the second fan module.

The plurality of fan blades of the first fan module may have a first length, the modifier may have a second length extending along the first fan module, and the first length and the second length may satisfy the following relationship:

$$0.5 \leq \text{the second length}/\text{the first length} \leq 2$$

The first fan module may have one or two fan blades than the second fan module.

The modifier may extend from the body by a step.

The stabilizer may have a first end and a second end, the second end is closer to the fan driver than the first end, and the modifier may be formed at the second end of the stabilizer.

The air conditioner may further include a heat exchanger in the housing, and a drain cover to collect condensed water generated from the heat exchanger, and the stabilizer may be mounted to the drain cover.

A plane of the body facing the fan may be formed to be flat.

A plane of the modifier facing the fan may be formed to be flat.

According to another aspect of the disclosure, an air conditioner includes a housing having an inlet and an outlet, a fan driver in the housing, a fan having an end coupled to the fan driver by a fastener, and including an installation space formed on an outer circumferential surface of the end to allow the fastener to pass through the installation space to couple the fan to the fan driver, and a stabilizer partitioning the fan into a portion to which air is brought in to the fan and a portion through which air is discharged from the fan, and including a modifier separated from the fan by a gap and concavely formed at an end of the stabilizer that is closest to the fan driver.

The installation space may allow at least a portion of a coupling tool for coupling the fan to the fan driver by the fastener to pass through.

The modifier may face the installation space.

The installation space may have first length along a rotation axis of the fan, the modifier may have second length along the fan, and the first length and the second length may satisfy the following relationship:

$$0.5 \leq \text{the second length}/\text{the first length} \leq 2$$

The stabilizer may include a body formed to have a step from the modifier, and a gap between the body and the fan has a first distance, the gap by which the modifier is separated from the fan has a second distance, and the first distance and the second distance satisfy the following relationship:

$$1.1 \leq \text{the second distance/the first distance} \leq 1.5$$

The fan may include a plurality of fan blades, and a distance between two adjacent fan blades of the plurality of fan blades forms the installation space, and may be greater than a distance between any other adjacent fan blades of the plurality of fan blades.

According to another aspect of the disclosure, an air conditioner includes a housing having an inlet and an outlet, a fan driver in the housing, a fan including a first fan module having first and second ends, with the first end coupled to the fan driver by a fastener, and having an installation space positioned to allow the fastener to pass through the installation space to couple the first end to the fan driver, and a second fan module coupled to the second end of the first fan module, and a stabilizer including a modifier extending along, and distanced from, the first fan module, and a body extending along, and distanced from, the second fan module, wherein the body is closer to the second fan module than the modifier is to the first fan module.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
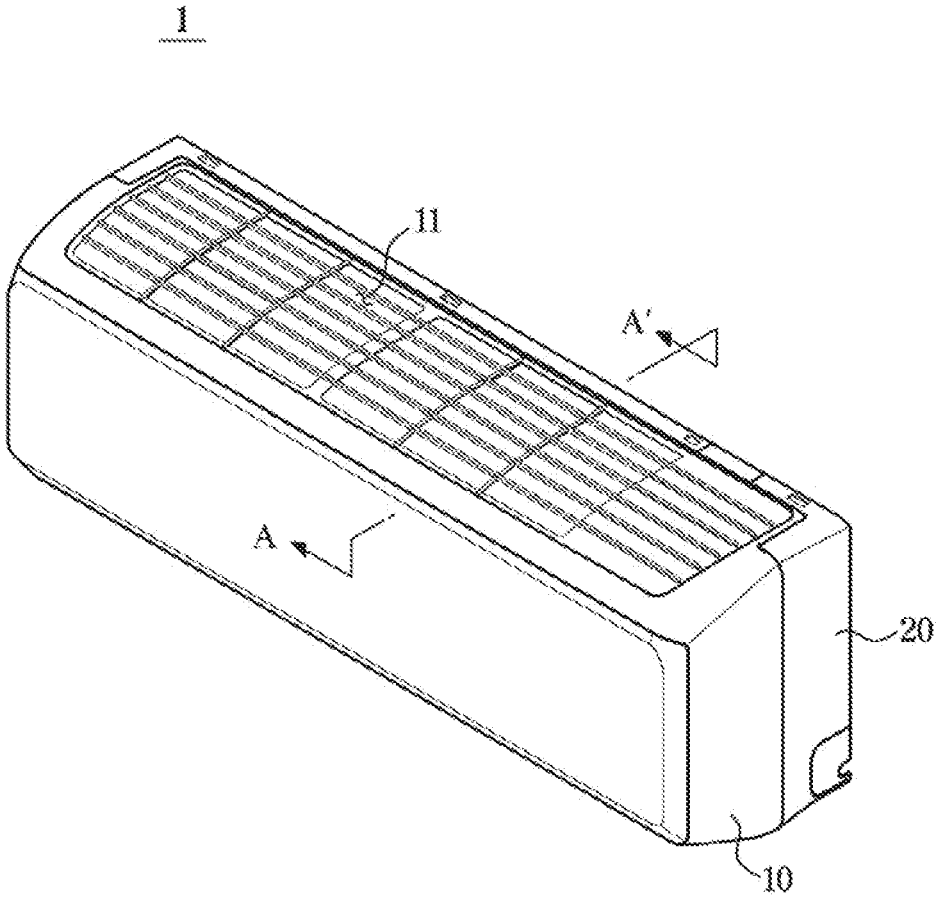
FIG. 1 shows an air conditioner, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the disclosure. Descriptions shall be understood as to include any and all combinations of one or more of the associated listed items when the items are described by using the conjunctive term "~and/or~," or the like.

The terms "front", "top", "bottom" and "left/right or side" as herein used are defined with respect to the drawings, but the terms may not restrict the shape and position of the respective components.

A refrigeration cycle of an Air conditioner (AC) is comprised of a compressor, a condenser, an expansion valve, and an evaporator. A refrigeration cycle involves a series of processes having compression, condensing, expansion, and evaporation to supply conditioned air that has exchanged heat with a refrigerant.

A compressor compresses a gas refrigerant into a high temperature and high pressure state and discharges the compressed gas refrigerant, and the discharged gas refrigerant flows into a condenser. A condenser condenses the compressed gas refrigerant into a liquid state, releasing heat to the surroundings.

An expansion valve expands the high temperature and high pressure liquid refrigerant condensed by the condenser to low pressure liquid refrigerant. An evaporator evaporates the refrigerant expanded by the expansion valve and returns the low temperature and low pressure gas refrigerant to the compressor. The evaporator attains a cooling effect using latent heat of vaporization of the refrigerant to exchange heat with an object to be cooled. Through this refrigeration cycle, the air conditioner may control air in a room.

An outdoor unit of the air conditioner refers to a part comprised of the compressor and an outdoor heat exchanger of the refrigeration cycle. The indoor unit of the air conditioner may include an indoor heat exchanger, and the expansion valve may be located in any of the indoor unit and the outdoor unit. Indoor and outdoor heat exchangers serve as the condenser or the evaporator. When the indoor heat exchanger is used as the condenser, the air conditioner becomes a heater, and when the indoor heat exchanger is used as the evaporator, the air conditioner becomes a cooler.

Although a wall-mounted type air conditioner to be installed on a wall will be taken as an example to explain a cross flow fan and a stabilizer of the air conditioner according to an embodiment of the disclosure, there are no limitations on types of air conditioner, and any type of air conditioner including a floor standing air conditioner or a ceiling-mounted air conditioner to which a cross flow fan and a stabilizer may be applied may be used.

Reference will now be made in detail to embodiments of the disclosure, which are illustrated in the accompanying drawings, wherein like reference numerals refer to the like elements throughout.

Figure 2:
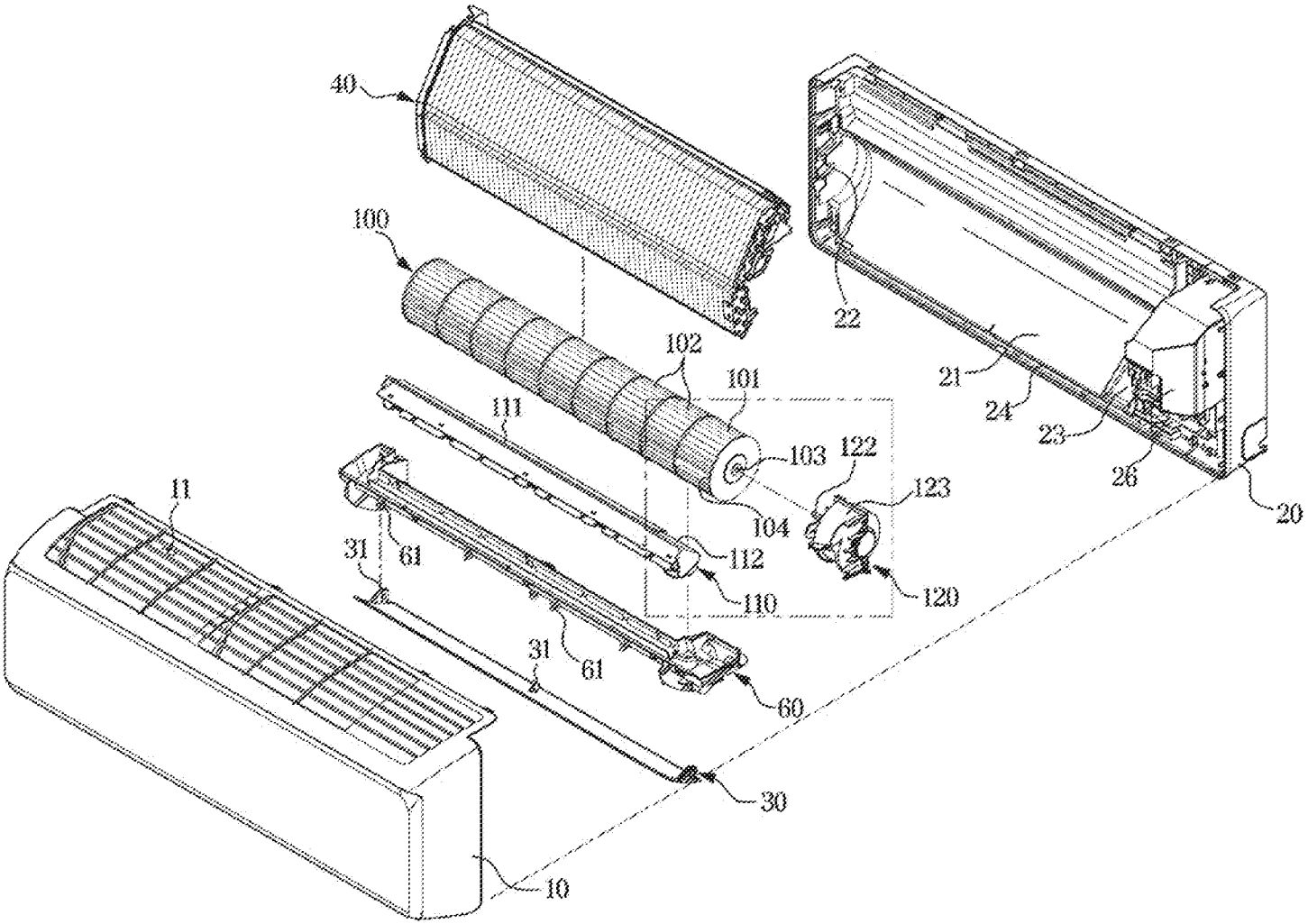
FIG. 2 is an exploded view of the air conditioner shown in FIG. 1.
Figure 3:
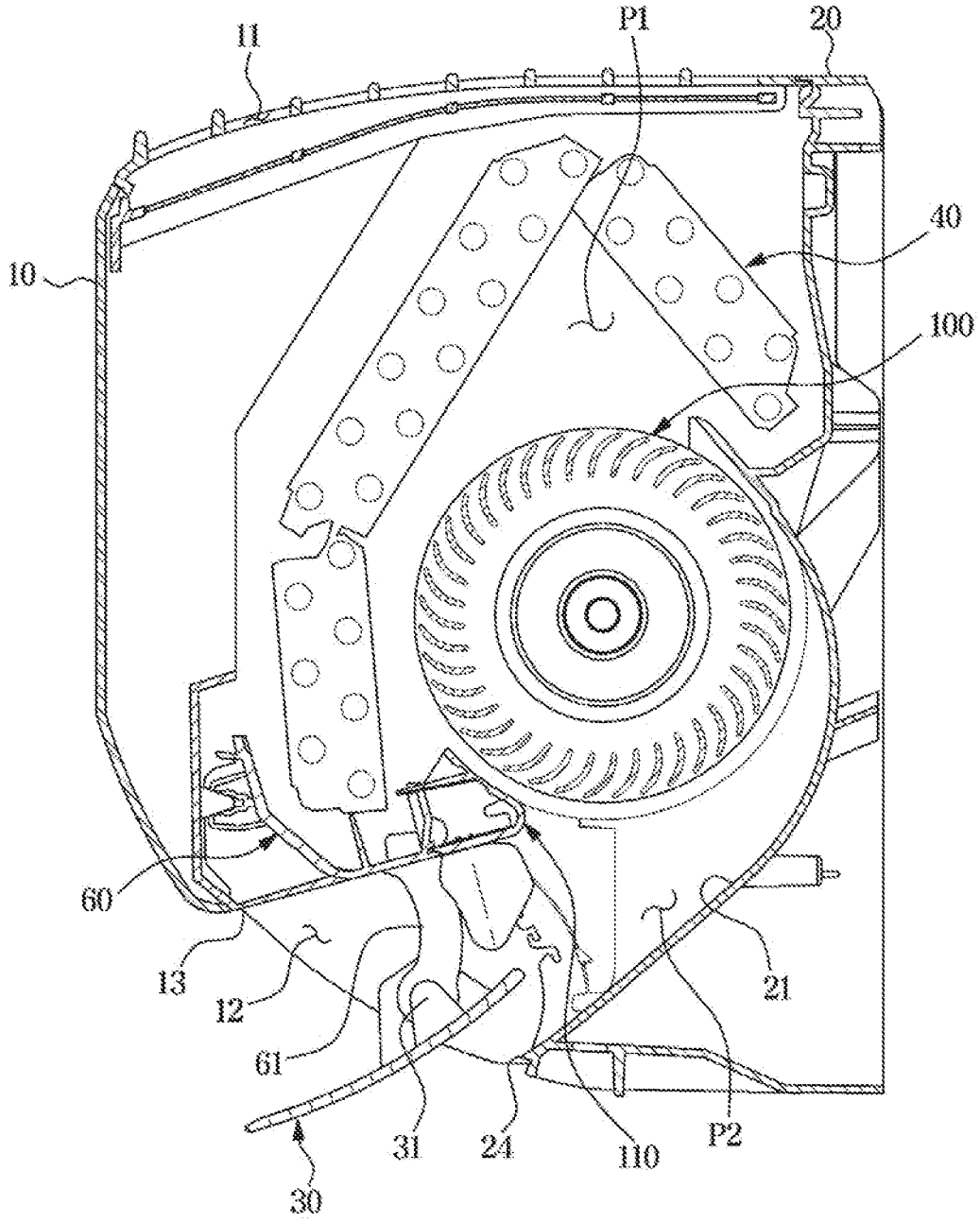
FIG. 3 is a cross-sectional view along line A-A' marked in FIG. 1.

FIG. 1 shows an air conditioner, according to an embodiment of the disclosure. FIG. 2 is an exploded view of the air conditioner shown in FIG. 1. FIG. 3 is a cross-sectional view along line A-A' marked in FIG. 1.

Referring to FIGS. 1 to 3, an air conditioner 1 may include a housing 10 and 20 having an inlet 11 and an outlet 12, a heat exchanger 40 for exchanging heat with air brought into the housing 10 and 20, and a fan 100 provided to bring in air through the inlet 11 and discharge air through the outlet 12.

The housing 10 and 20 may define the whole exterior of the air conditioner 1. The housing 10 and 20 may include a first housing 10, and a second housing 20 to cover a rear portion of the first housing 10. The inlet 11 through which air is brought in and the outlet 12 through which air is discharged may be formed on the housing 10 and 20.

The inlet 11 may be located on the top plane of the first housing 10. Alternatively, the inlet 11 may be located on the front or a side of the first housing 10. The inlet 11 may have the shape of a grill to prevent foreign materials from flowing in.

The outlet 12 may be located on the bottom plane of the housing 10 and 20. The outlet 12 may be formed by a first outlet end 13 of the first housing 10 and a second outlet end 24 of the second housing 20. Alternatively, the outlet 12 may be formed on the front of the first housing 10.

In an embodiment of the disclosure, as the air conditioner 1 is installed on a wall and has the rear side of the housing 10 and 20 face the wall, the inlet 11 and the outlet 12 may be formed on the top, bottom, front, or left or right side.

The second housing 20 may be coupled to the first housing 10. The second housing 20 may cover the rear side of the first housing 10. The second housing 20 may include a flow path definer 21. The flow path definer 21 may be formed to guide air that has passed the fan 100 to the outlet 12. The second outlet end 24 may be located at the bottom end of the flow path definer 21.

The second housing 20 may include a fan supporter 22 for supporting the fan 100 such that the fan 100 is able to rotate. The second housing 20 may include a driver installation portion 23 in which the fan driver 120 is installed. The driver installation portion 23 may be located on a side opposite to the other side where the fan supporter 22 is located.

A controller 26 may be equipped in the second housing 20 to control operation of the air conditioner 1. The controller 26 may be located at an end of the second housing 20. The controller 26 may be arranged to be adjacent to the fan driver 120.

The air conditioner 1 may include an airflow guide 30 arranged to open or close the outlet 12. The airflow guide 30 may be rotatably arranged on the outlet 12. The airflow guide 30 may be rotatably arranged against the housing 10 and 20. The airflow guide 30 may be rotatably coupled to a drain cover 60. As the airflow guide 30 is rotated against the housing 10 and 20, the airflow guide 30 may control the direction of airflow discharged from the outlet 12.

The heat exchanger 40 may be arranged to cover the front and top of the fan 100. The heat exchanger 40 may be arranged to be adjacent to the fan 100. The heat exchanger 40 may be placed in an air flow path between the inlet 11 and the fan 100. The air brought in through the inlet 11 passes the heat exchanger 40 and exchanges heat, and is then discharged through the outlet 12. Although not shown, the heat exchanger 40 may be placed in an air flow path between the fan 100 and the outlet 12.

The air conditioner 1 may include the drain cover 60 provided to collect condensed water produced from the heat exchanger 40. The drain cover 60 may be arranged underneath the heat exchanger 40. The drain cover 60 may be coupled to a drain hose (not shown) extending to the outside of the housing 10 and 20 to discharge the collected condensed water to the outside of the housing 10 and 20.

The airflow guide 30 may include a guide coupler 31. The drain cover 60 may include a guide supporter 61. The guide coupler 31 of the airflow guide 30 may be rotatably coupled to the guide supporter 61 of the drain cover 60.

The fan 100 may be arranged in the housing 10 and 20. The fan 100 may be a cross flow fan extending in the same direction as the length of the housing 10 and 20. The fan 100 may be rotatably coupled to the second housing 20.

The air conditioner 1 may include the fan driver 120 for driving the fan 100. The fan driver 120 may be coupled to the fan 100. The fan driver 120 may be installed in the second housing 20.

The air conditioner 1 may include a stabilizer 110 provided to guide air around the fan 100. The stabilizer 110 may be provided to determine a blowing direction of the fan 100. The stabilizer 110 may be installed at the drain cover 60. The stabilizer 110 may be installed at an inner end of the drain cover 60. The stabilizer 110 may form a discharging flow path P2 with the flow path definer 21. The stabilizer 110 may form part of an upper portion of the discharging flow path P2, and the flow path definer 21 may form a lower portion of the discharging flow path P2.

The stabilizer 110 may separate an air sucking path from an air discharging path of the fan 100. The stabilizer 110 may extend along the direction of a rotation axis of the fan 100 to partition the fan 100 into an inflow portion and an outflow portion. The fan 100 may be divided by the stabilizer 110 into a portion to which air is brought in and a portion from which air is discharged, thereby preventing air being discharged from the fan 100 from flowing back into the fan 100 and thus stabilizing flows of the air. The stabilizer 110 may guide air blown by the fan 10 to the outlet 12 by forming a flow branch of the air.

The drain cover 60 and the stabilizer 110 may prevent air that has passed the discharging flow path P2 from moving back to the heat exchanger 40. The drain cover 60 and the stabilizer 110 may separate an inflow path P1 from the discharging flow path P2. With the drain cover 60 and the stabilizer 110 separating the inflow path P1 from the discharging flow path P2, the air that has passed the heat exchanger 40 may be all discharged through the outlet 12. Accordingly, the air conditioner 1 may prevent degradation of heat exchange performance and prevent a loss of air volume.

Figure 4:
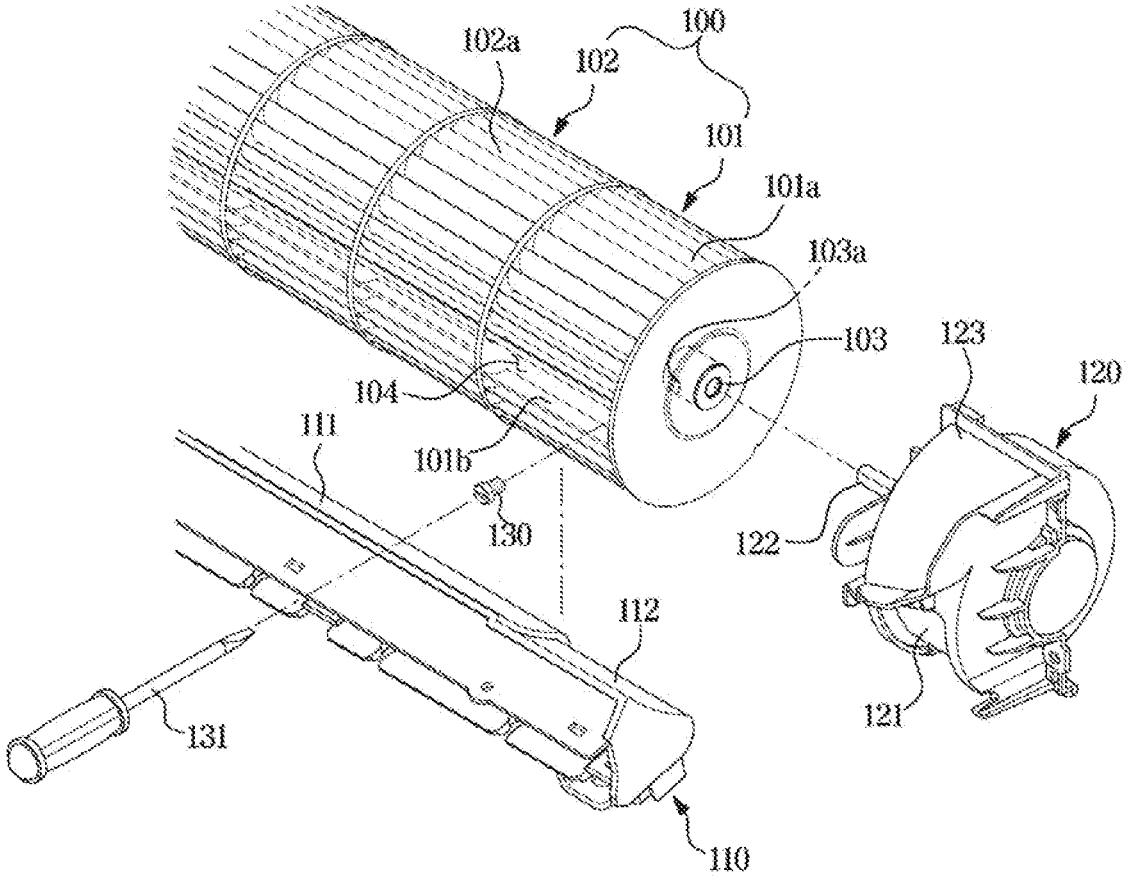
FIG. 4 is an enlarged view of a portion of a fan, a portion of a stabilizer, and a fan driver shown in FIG. 2.
Figure 5:
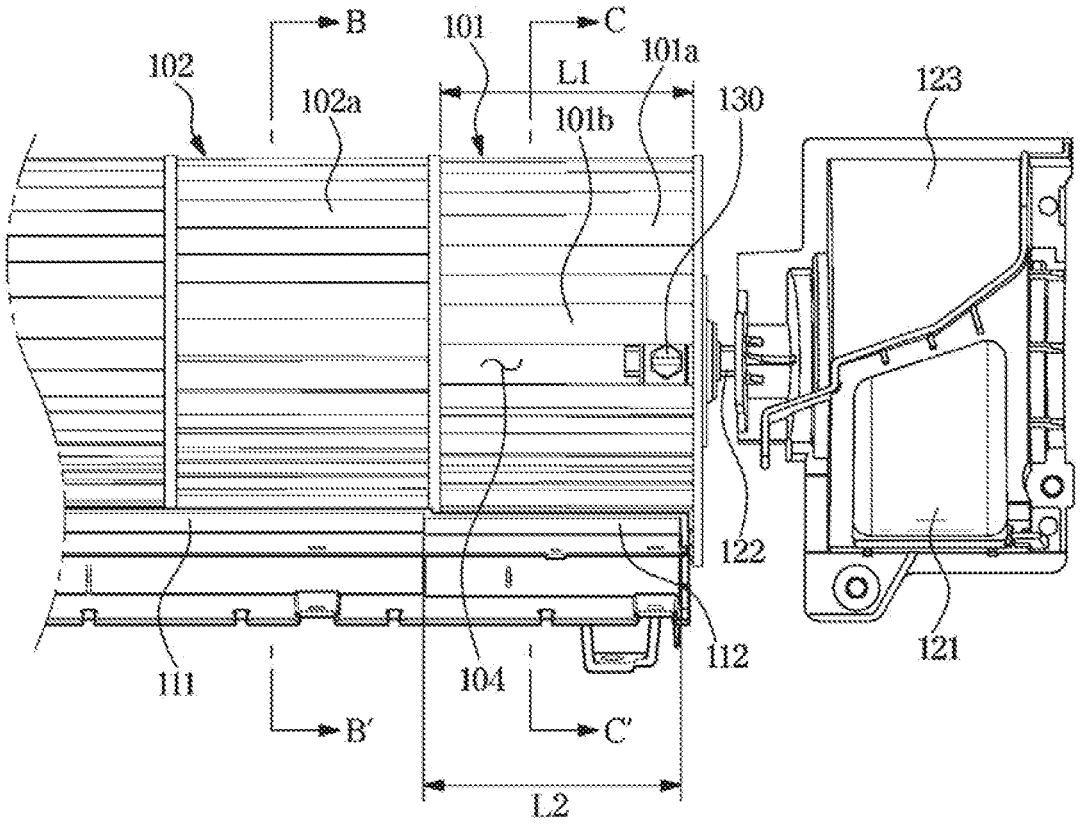
FIG. 5 is a plan view of a fan, a fan driver, and a stabilizer shown in FIG. 2 after the installation of the fan, fan driver, and stabilizer completes.
Figure 6:
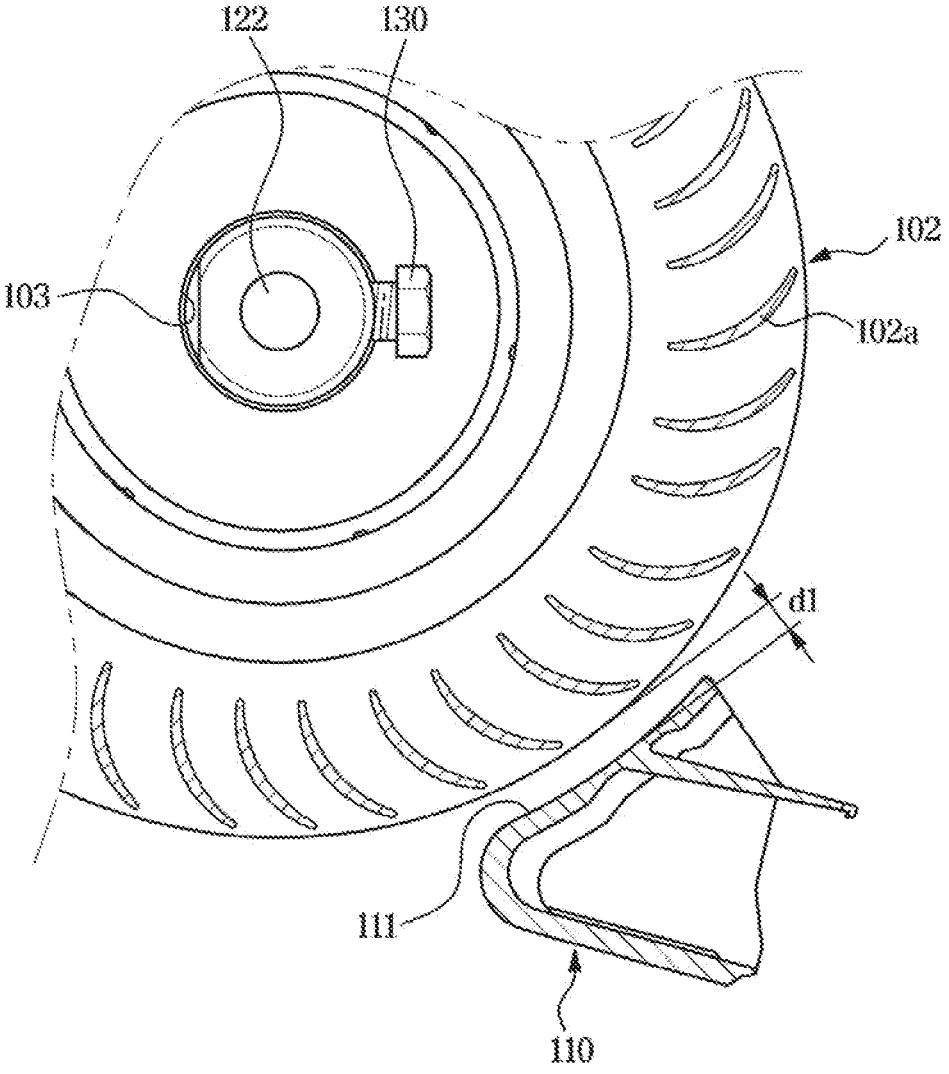
FIG. 6 is a cross-sectional view along line B-B' marked in FIG. 5.
Figure 7:
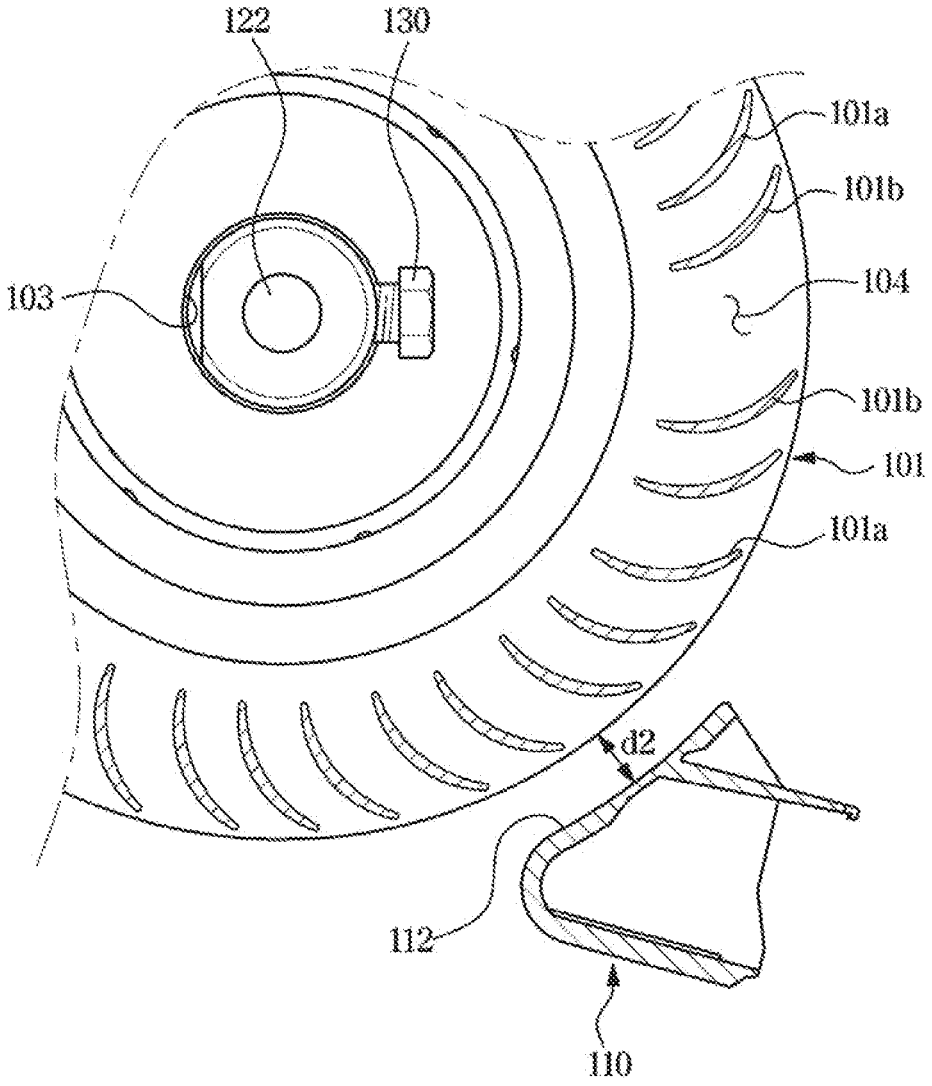
FIG. 7 is a cross-sectional view along line C-C' marked in FIG. 5.

FIG. 4 is an enlarged view of a portion of the fan, a portion of the stabilizer, and the fan driver shown in FIG. 2. FIG. 5 is a plan view of the fan, the fan driver, and the stabilizer shown in FIG. 2 after the installation of the fan, fan driver, and stabilizer completes. FIG. 6 is a cross-sectional view along line B-B' marked in FIG. 5. FIG. 7 is a cross-sectional view along line C-C' marked in FIG. 5.

Referring to FIGS. 2 and 4, the fan driver 120 may be coupled onto a side of the fan 100. The fan 100 may include a first fan module 101 a side of which is coupled to the fan driver 120, and a second fan module 102 coupled to the other side of the first fan module 101.

The first fan module 101 may include a plurality of first fan blades 101*a*, an installation space 104, and a driving coupler 103.

Referring to FIGS. 4 and 7, two fan blades 101*b* of the plurality of first fan blades 101*a* may be arranged with a first gap therebetween. The installation space 104 may be formed between the two fan blades 101*b*. The other fan blades of the plurality of fan blades 101*a* may be arranged with a second gap therebetween, where the second gap is less than the first gap. The first fan module 101 may have a form that has one or two less fan blades than the second fan blades 102*a* of the second fan module 102.

The first fan module 101 may be manufactured in a method of removing one or two fan blades of a fan module, such as by removing one or two of the second fan blades 102*a* from a fan module such as the second fan module 102, to form the installation space 104. Alternatively, unlike the second fan module 102, the first fan module 101 may be manufactured to have the installation space 104 in an injection molding method.

The driving coupler 103 may be formed on one side of the first fan module 101, to which the fan driver 120 is coupled. The driving coupler 103 may be fixedly coupled with a shaft of the fan driver 120. Accordingly, the fan 100 may receive rotational force from the fan driver 120.

The installation space 104 may be formed in the first fan module 101 of the fan 100 coupled to the fan driver 120. The installation space 104 may be formed on an outer circumferential surface of the first fan module 101.

The installation space 104 may be formed between the two fan blades 101*b* of the plurality of fan blades 101*a*. The installation space 104 may be formed such that a fastening member 130 for fastening the fan driver 120 to the fan 100 may pass through the installation space 104. The installation space 104 may be formed such that at least a portion of a coupling tool 131 for coupling the fastening member 130 to the fan driver 120 and the fan 100 may pass through the installation space 104.

With this structure, to couple the fan driver 120 to the fan 100, a worker may insert a driving shaft 122 of the fan driver 120 to the driving coupler 103 of the first fan module 101, and then couple the fastening member 130 into a coupling hole 103*a* of the driving coupler 103 through the installation space 104. Furthermore, the worker may insert a portion of the coupling tool 131 to the inside of the first fan module 101 through the installation space 104 to fasten the fastening member 130 to the driving coupler 103 and the driving shaft 122.

The second fan module 102 may include the plurality of second fan blades 102*a*. All of the plurality of second fan blades 102*a* may be arranged with the same gap. As the second fan module 102 is fixed to the first fan module 101, the second fan module 102 may be rotated along with the first fan module 101. The second fan modules 102 may be successively arranged along the direction of the rotation axis of the fan 100. The second fan module 102 may extend along the direction of the rotation axis of the fan 100.

The fan driver 120 may be coupled to an end of the first fan module 101 of the fan 100 with the installation space 104 formed therein. The fan driver 120 may include a fan motor 121, the driving shaft 122, and a motor case 123.

The fan motor 121 may generate driving force to rotate the fan 100. The driving shaft 122 may transfer the driving force generated from the fan motor 121 to the fan 100. The motor case 123 may cover the fan motor 121. The fan motor 121 may be installed in the housing 10 and 20 while accommodated in the motor case 123.

In the meantime, when the distance between the stabilizer 110 and the fan 100 is small, air-blowing capabilities may be improved but noise may increase as well. On the other hand, when the distance between the stabilizer 110 and the fan 100 is larger, air-blowing capabilities may decline, thereby causing a loss of air volume.

Furthermore, the installation space 104 formed in the fan 100 for coupling with the fan driver 120 causes changes in pressure between the stabilizer 110 and the installation space 104, leading to periodic noise occurrence.

Referring to FIGS. 5 to 7, the stabilizer 110 may include a body 111 formed to keep a distance to the fan 100 as first distance d1, and a modifier 112 formed to keep a distance to the fan 100 as distance d2 which is greater than the first distance d1. The first distance d1 and the second distance d2 may satisfy the following relationship:

$$1.1 \leq \text{second distance } d2/\text{first distance } d1 \leq 1.5$$

The second distance d2 may be formed to be 1.5 times the first distance d1. Accordingly, in an embodiment of the disclosure, the air conditioner 1 may minimize a loss of air volume and reduce noise occurring in the installation space 104.

The body 111 may extend along the direction in which the rotation axis of the fan 100 extends. The body 111 may extend as much as the length of the second fan module 102. A plane of the body 111 that faces the fan 100 may be formed as a flat plane. Alternatively, the plane of the body 111 that faces the fan 100 may be formed as a curved plane having certain curvature. In another example, the plane of the body 111 that faces the fan 100 may have a bending portion.

The body 111 may be arranged to match the second fan module 102. Air blown from the second fan module 102 may be guided by the body 111 into the discharging flow path P2.

The body 111 may be arranged to be closer to the fan 100 than the modifier 112 is. As the body 111 is arranged to be closer to the fan 100 than the modifier 112 is, the air conditioner according to an embodiment of the disclosure may minimize a loss of air volume.

The modifier 112 may be concavely formed and separated from the fan 100 by a distance. The modifier 112 may be arranged to be farther from the fan 100 than the body 111 is from the fan 100.

The modifier 112 may be formed at an end of the stabilizer 110 near the fan driver 120. The modifier 112 may be located to match the installation space 104. The modifier 112 may be arranged to face the installation space 104.

The modifier 112 may be arranged to match the first fan module 101. Air blown from the first fan module 101 may be guided by the modifier 112 into the discharging flow path P2.

As the modifier 112 is formed in a portion of the stabilizer 110 that matches the first fan module 101 with the installation space 104 formed thereon, the air conditioner 1 in accordance with an embodiment of the disclosure may minimize a loss of air volume and reduce periodic noise caused by the installation space 104.

Therefore, as can be clearly seen from the various figures, the body 111 has at least a portion extending along the fan 100 at a first distance d1 from the fan 100, and so as to not be over the installation space 104 as the fan 100 rotates, Moreover, as can be clearly seen from the various figures, the modifier 112 extends along the fan 100 at a second distance d2, which is greater than the first distance d1, from the fan 100, and so as to be over the installation space 104 for at least part of a full rotation of the fan 100 as the fan 100 rotates.

Specifically, in an embodiment of the disclosure, the air conditioner 1 may minimize a loss of air volume and reduce noise due to the installation space 104 by increasing the distance to the fan 100 from a portion of the stabilizer 110 that matches the first fan module 101, from which the noise occurs, and keeping the distance to the fan 100 from the other portion of the stabilizer 110 close.

The modifier 112 may be formed to have a step from the body 111. A plane of the modifier 112 that faces the fan 100 may be formed as a flat plane. Alternatively, the plane of the modifier 112 that faces the fan 100 may be formed as a curved plane having certain curvature. In another example, the plane of the modifier 112 that faces the fan 100 may have a bending portion.

Referring to FIG. 5, assuming that the first fan blades 101*a*, which include the two fan blades 101*b* with the installation space 104 formed therebetween, has first length L1, and the modifier 112 of the stabilizer 112 has second length L2, the first length L1 and the second length L2 may satisfy the following relationship:

$$0.5 \leq \text{second length } L2/\text{first length } L1 \leq 2$$

The first length L1 may be the length of the installation space 104 along the rotation axis of the fan 100.

The second length L2 may be the same as the first length L1. Accordingly, in an embodiment of the disclosure, the air conditioner 1 may minimize a loss of air volume and reduce noise occurring in the installation space 104.

According to embodiments of the disclosure, with a stabilizer equipped with a modifier, an air conditioner may reduce noise.

According to embodiments of the disclosure, an air conditioner may prevent a loss of air volume and reduce noise with a stabilizer equipped with a modifier in a portion of the stabilizer.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

What is claimed is:

1. An air conditioner comprising:
a housing having an inlet and an outlet;
a fan in the housing to suck in air through the inlet and discharge air through the outlet, and including:
a first fan module longitudinally arranged along an axis of rotation of the fan, the first fan module including a plurality of fan blades with an installation space between two fan blades of the plurality of fan blades, and
a second fan module longitudinally arranged along the axis of rotation adjacent to a first end of the first fan module, the second fan module including a plurality of fan blades;
a fan driver coupled to a second end of the first fan module by a fastener, to drive the fan, wherein the installation space is positioned to allow the fastener to pass through the installation space to couple the fan driver to the second end of the first fan module; and
a stabilizer including:
a body having at least a portion longitudinally extending along the second fan module at a first distance from the second fan module, and so as to not be over the installation space as the fan rotates, and
a modifier longitudinally extending along the first fan module at a second distance, which is greater than the first distance, from the first fan module, and so as to be over the installation space for at least part of a full rotation of the fan as the fan rotates.

2. The air conditioner of claim 1, wherein the modifier extends from the body.

3. The air conditioner of claim 1, wherein the installation space allows at least a portion of a coupling tool for coupling the fan driver to the second end of the first fan module by the fastener to pass therethrough.

4. The air conditioner of claim 1, wherein the first distance and the second distance satisfy the following relationship:

$$1.1 \leq \text{the second distance/the first distance} \leq 1.5.$$

5. The air conditioner of claim 1, wherein
the plurality of fan blades of the first fan module has a first length,
the modifier has a second length extending along the first fan module, and
the first length and the second length satisfy the following relationship:

$$0.5 \leq \text{the second length/the first length} \leq 2.$$

6. The air conditioner of claim 1, wherein the first fan module has one or two less fan blades than the second fan module.

7. The air conditioner of claim 1, wherein the modifier extends from the body by a step.

8. The air conditioner of claim 1, wherein the stabilizer has a first end and a second end, the second end is closer to the fan driver than the first end, and the modifier is formed at the second end of the stabilizer.

9. The air conditioner of claim 1, further comprising:
a heat exchanger in the housing; and
a drain cover to collect condensed water generated from the heat exchanger,
wherein the stabilizer is mounted to the drain cover.

10. An air conditioner comprising:
a housing having an inlet and an outlet;
a fan driver in the housing;
a fan including
a first fan module having first and second ends, with the first end coupled to the fan driver by a fastener, and having an installation space positioned to allow the fastener to pass through the installation space to couple the first end to the fan driver, and
a second fan module coupled to the second end of the first fan module; and
a stabilizer partitioning the fan into a portion to which air is brought in to the fan and a portion from which air is discharged from the fan, and including:
a body longitudinally extending along the second fan module at a first distance from the second fan module so as to not be over the installation space as the fan rotates, and
a modifier longitudinally extending along the first fan module at a second distance, greater than the first distance, from the first fan module so as to be over the installation space for at least a part of a full rotation of the fan as the fan rotates, and concavely formed at an end of the stabilizer that is closest to the fan driver.

11. The air conditioner of claim 10,
wherein the installation space allows at least a portion of a coupling tool for coupling the first end of the first fan module to the fan driver by the fastener to pass therethrough.

12. The air conditioner of claim 10, wherein the modifier faces the installation space.

13. The air conditioner of claim 12, wherein
the installation space has a first length along a rotation axis of the fan,
the modifier has a second length longitudinally extending along the fan, and
the first length and the second length satisfy the following relationship:

$$0.5 \leq \text{the second length/the first length} \leq 2.$$

14. The air conditioner of claim 10, wherein the modifier is stepped from the body, and the first distance and the second distance satisfy the following relationship:

$$1.1 \leq \text{the second distance/the first distance} \leq 1.5.$$

15. The air conditioner of claim 10, wherein the first fan module comprises a plurality of fan blades, and a distance between two adjacent fan blades of the plurality of fan blades forms the installation space, and is greater than a distance between any other adjacent fan blades of the plurality of fan blades.

16. An air conditioner comprising:

a housing having an inlet and an outlet;

a fan driver in the housing;

a fan including a first fan module having first and second ends, with the first end coupled to the fan driver by a fastener, and having an installation space positioned to allow the fastener to pass through the installation space to couple the first end to the fan driver, and a second fan module coupled to the second end of the first fan module; and a stabilizer including a modifier longitudinally extending along, and distanced from, the first fan module, so as to be over the installation space for at least a part of a full rotation of the fan as the fan rotates, and a body longitudinally extending along, and distanced from, the second fan module, so as not to be over the installation space as the fan rotates, wherein the body is closer to the second fan module than the modifier is to the first fan module.

* * * * *